US005694826A

United States Patent [19]

Slivinski

[11] Patent Number: 5,694,826

[45] Date of Patent: Dec. 9, 1997

[54] LACING STITCH STARTER TOOL

[75] Inventor: Mary Slivinski, Nashua, N.H.

[73] Assignee: Pepperell Braiding Company Inc., Pepperell, Mass.

[21] Appl. No.: 692,457

[22] Filed: Aug. 5, 1996

[51] Int. Cl.[6] ..... D04C 3/36

[52] U.S. Cl. ..... 87/62; 57/1 R; 87/33; 87/52; 289/15; 289/17; 289/18.1

[58] Field of Search ..... 289/15, 17, 18.1; 87/62, 33, 52; 57/1 R

[56] References Cited

U.S. PATENT DOCUMENTS

| | | | |
|---|---|---|---|
| 519,258 | 5/1894 | Hill . | |
| 1,203,781 | 11/1916 | Ratyca . | |
| 2,395,981 | 3/1946 | Walker | 28/15 |
| 2,500,004 | 3/1950 | Nielsen | 289/17 |
| 2,825,592 | 3/1958 | Semple | 289/17 |
| 3,073,636 | 1/1963 | Boutwell | 289/17 |
| 3,434,750 | 3/1969 | Hetrick | 289/17 |
| 3,688,357 | 9/1972 | Neilsen et al. | 289/15 |
| 4,045,061 | 8/1977 | Fierro | 289/18 |
| 4,088,351 | 5/1978 | Roth | 289/18 |
| 4,307,737 | 12/1981 | Shipman | 87/33 |
| 4,369,690 | 1/1983 | Sapkus | 87/33 |
| 5,104,160 | 4/1992 | Cheng | 289/17 |
| 5,217,470 | 6/1993 | Weston | 289/17 |

*Primary Examiner*—William Stryjewski
*Attorney, Agent, or Firm*—Henry S. Miller

[57] ABSTRACT

A hand held tool for starting lace stitching or braiding, including a firm, stabilizing ridge about the perimeter with a relatively thin, flexible plastic panel within the perimeter. The panel includes a systematic scheme of holes that are interconnected by channels. The holes are sized and shaped to accommodate a particular lacing material and the holes are arranged to permit a particular design in the finished gimp. The tool is removed from the finished gimp with the exertion of a gentle separating force.

20 Claims, 7 Drawing Sheets

LACING STITCH STARTER TOOL

BACKGROUND OF THE INVENTION

1. Field of the Invention

This invention relates generally to the field of handicraft devices and in particular to a new device and educational tool for teaching and starting a plastic lacing stitch.

2. Relevant Prior Art

Plastic lace is known by many names to those in the handicraft field, it is most commonly referred to as "gimp", "lanyard" and "boondoggle" with all terms having a common meaning. The techniques for using and handling plastic lacing are well known in the art and are believed to have begun before sailors tied knots as a past time and revived the ancient art that we call macramé. The braid of the plastic lace is more closely related to the world of ranchers and cowboys who used leather braid to make bridles, reins, lariats and hatbands. The cowboys boondoggled, and made saddle trappings out of odds and ends of leather, during slack work periods of the ranch. The craft continued with the advent of artificial leather. A period of celluloid gimp followed before it was replaced by the vinyl, however polyvinyl chloride is currently the lace material of choice.

Gimp as a handicraft has endured because of its repetitive aspects, making it attractive to children, according to child development specialists who see the need for success in industrious projects for young children.

The most difficult step for the person engaged in the lacing process is starting. The typical youngster has small fingers with limited coordination and manual dexterity. The same is often true of the elderly and some infirmed persons. Such conditions make handling at least two long strips of slippery plastic lace a challenge. Customarily the process begins with the child holding the plastic lace between the thumb and forefinger of one hand and attempting to tie an over hand knot with or without a loop. Once the knot is successfully tied, the lacing is folded in a pattern according to the style of braid or stitch used, while the knot is still held between the thumb and forefinger. After and inch or more of the gimp has been formed the knot may be released and held by the newly formed body of gimp.

While this first step in the gimp process is difficult and perhaps impossible for young and learning disabled children to accomplish, the prior art fails to disclose any means for simplifying the first step and fulfilling this long-standing need. Other handicrafts provide frames and supports to allow the materials of the craft to be held, thereby freeing the craftsman's hands to practice the art.

The U.S. Patents are cited to show examples as to the state of the art as it relates to handicrafts. U.S. Pat. No. 1,203,781 issued Nov. 16, 1916 to Ratyca for a novelty device in the form of a support for holding the cords from which braidwork is made and in particular braided belts. U.S. Pat. No. 2,395,981 issued Mar. 5, 1946 to Walker for a knotting board which holds a plurality of threads a predetermined distance apart to permit other threads to be woven therebetween. U.S. Pat. No. 3,688,357 issued Sep. 5, 1972 to Neilsen et al for a macramé loom which includes a base plate with flanges at each end. One flange contains a plurality of spaced pins and the other flange contains a plurality of hook-shaped configurations that are spring biased to maintain tension on the string held between the two flanges. U.S. Pat. No. 4,088,351 issued May 9, 1978 to Roth for a macramé frame for holding and clamping macramé cords. U.S. Pat. No. 5,104,160 issued Apr. 14, 1992 to Cheng, shows a hand held device for looping a noose around and sealing the inflation end of a balloon. U.S. Pat. No. 4,045,061 issued Aug. 30, 1977 to Fierro for a macramé supporting board which includes a base with a plurality of holes adapted to accept marker pins used during the knotting process. U.S. Pat. No. 519,258 issued May 1, 1894 to G. P. Hill for a darning or embroidering frame, which includes an adjustable ring or frame to which is secured a series of independently revoluble angular fingers and means for holding the fingers in predetermined position, thereby holding the fabric stretched across the frame in a desired manner.

There exists then, a need for a tool means that will allow a user of gimp to start the lacing stitch with ease and simplicity. The field of prior art into which the craft of gimp falls is completely lacking in any such tool. The references cited as examples of the prior art taken alone or in combination fail to show, describe or suggest the invention herein presented. The instant invention as disclosed and claimed provides distinct and useful advantages not previously known.

SUMMARY OF THE INVENTION

The invention is a hand held craft tool that is characterized by a planar panel of polymeric material containing a plurality selectively positioned and sized apertures adapted to receive specific lacing and stitching materials. The apertures are interconnected by throughgoing channels which aid in the function of the tool. The panel is supported by a stabilizing ridge around its perimeter that is formed of a material which is the same or similar to the panel material. The stabilizing ridge preferably extents above and below the plane of the panel in equal dimension thereby making the tool easier to grasp with the fingers. The supporting ridge would work equally as well if the ridge extended in one direction, transverse to the plane of the panel. The ridge may be formed as an integral part of the panel and would include a sloping surface that extends away from the panel to the distal parallel surface of the stabilizing ridge.

The apertures are located generally, proximate the center of the panel and equidistant from the stabilizing ridge, dependent upon the number and pattern of the apertures. The apertures are required to be of a size and shape that will create a sliding fit between the walls of the aperture and the lacing material. Since the lacing material currently available is either round or quadrilateral in cross section, the apertures of the invention will be annular or quadrilateral. If lacing material becomes available that is otherwise shaped in cross section, it is within the scope and intent of this invention to provide a handicraft tool of the type disclosed herein with apertures consistent with the cross section of the then available lacing material.

In use, the starter tool is held by the user in one hand and each end of one lace of selected length is placed through the apertures located at either end of one channel until the two ends extend beyond the starter tool an equal length. A second lace of the selected length is placed through the apertures located at either end of the other or next channel if there are more than two until the two ends extend beyond the starter tool an equal length. This is repeated until all apertures are filled. With two laces, one side of the tool exhibits two short sections of lace in a transverse relation, with the second overlying the first and both passing through the apertures to the opposed side of the tool. The laces are secure and cannot move from the position in the tool.

The opposed side of the tool displays four long sections of lacing material. The tool may then be released and set down, for example, picnic table, park bench or other suitable surface. The user craftsperson now has both hands free to make gimp in various styles available, round or square, limited only by the skill of the weaver.

When completed or near completion, the user has several inches of gimp with a starter tool attached to one end. Because of the unique design of the tangential intersection between the aperture and the channel it is possible to simply grasp the gimp in one hand and the starter tool in the other hand and by applying minimal force the two will separate. The lacing, which was secured through the apertures, will cause the apertures to flex and distort and release the finished gimp. Due to the memory constant of the polymeric material of the panel the starter tool resumes its shape and is immediately ready to be reused.

It is therefore a primary object of the invention to provide a new and hitherto unknown lace stitch starter tool.

It is another object of the invention to provide a new and improved lace stitch starter tool that is small and easily handled by children.

It is another object of the invention to provide a new and improved educational tool that aids in the teaching of the method of starting a plurality of different lace stitching.

It is a further object of the invention to provide a new and improved lace stitch starter tool that is simple to use.

It is still another object of the invention to provide a new and improved lace stitch starter tool that is easily removed when no longer needed.

It is still a further object of the invention to provide a new and improve lace stitch starter tool that is capable of being reused.

It is another object of the invention to provide a new and improved lace stitch starter tool which is adaptable to be held by elderly and infirmed hands.

It is another object of the invention to provide a new and improved lace stitch starter tool which may be easily and efficiently manufactured and marketed.

These, together with other objects of the invention, along with the various features of novelty which characterize the invention, are pointed out with particularity in the claims annexed to and forming a part of this disclosure. For a better understanding of the invention, its operation advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
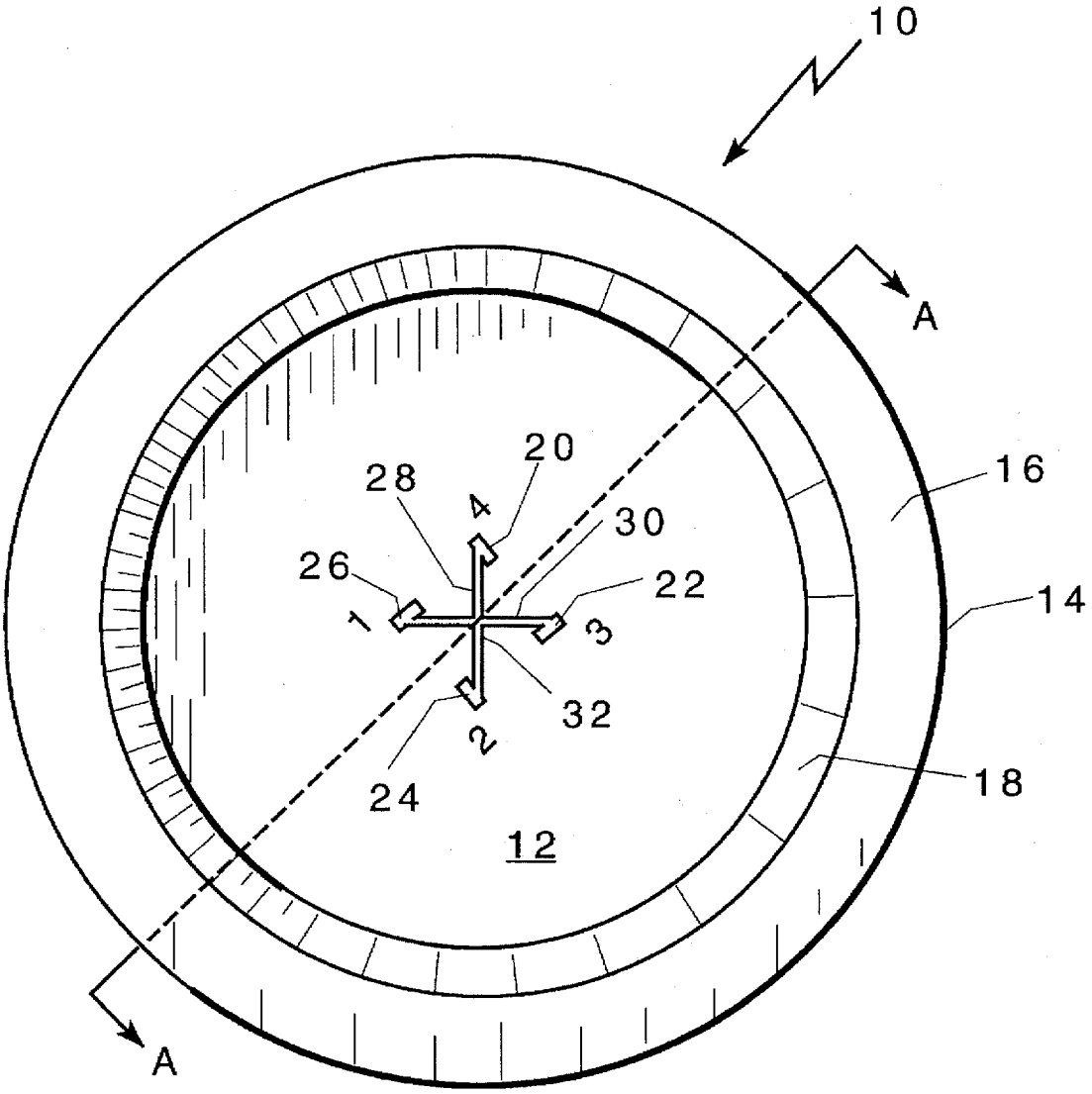
FIG. 1 is a top plan view of the tool of the invention.

Referring now to FIG. 1, the invention is shown generally a 10. A planar panel 12 is surrounded by a stabilizing ridge 14 which may be formed as an integral part of the panel in the manufacturing process. Ridge 14 is substantially larger in dimension then panel 12 and includes a surface 16 which is superior in position and parallel to panel 12, Accordingly, a surface 18 of stabilizing ridge 14 engages panel 12 at an angle of approximately forty-five degrees which adds to the strength and stability of the panel and eliminates associated undesirable effects. The panel is formed of a high-density polyethylene material which has the inherent favorable qualities of strength, flexibility and resilient memory. The stabilizing ridge may be formed from the same material as the panel or other similar material with like characteristics.

At a central location on the surface of panel 12 are a plurality of throughgoing apertures and channels. The apertures and channels are configured, shaped and connected in a manner that allows the tool of the invention to initially restrict movement of the lacing material. After the lacing process has progressed, the tool is easily removed without adverse effect on the article of gimp. In FIG. 1, the tool is adapted to accept flat plastic lacing material which is in common use today. The apertures 20, 22, 24 and 26 are rectangular in shape and sized to form a sliding fit with the lacing material. The apertures are positioned so that opposite apertures, for example 20,24 and 22,26, have longitudinal axis that lie in parallel planes. Each pair of opposed apertures are connected by a channel 28, 30 which are transversely oriented and intersect at a point 32. The channels intersect the apertures proximate the end of the rectangle which is distal from an imaginary line which would be common to the shorter dimension of both rectangles. The channel occupies approximately fifty percent of one side of one wall defining the aperture and as constructed forms a forty-five degree angle with that wall.

Figure 1A:
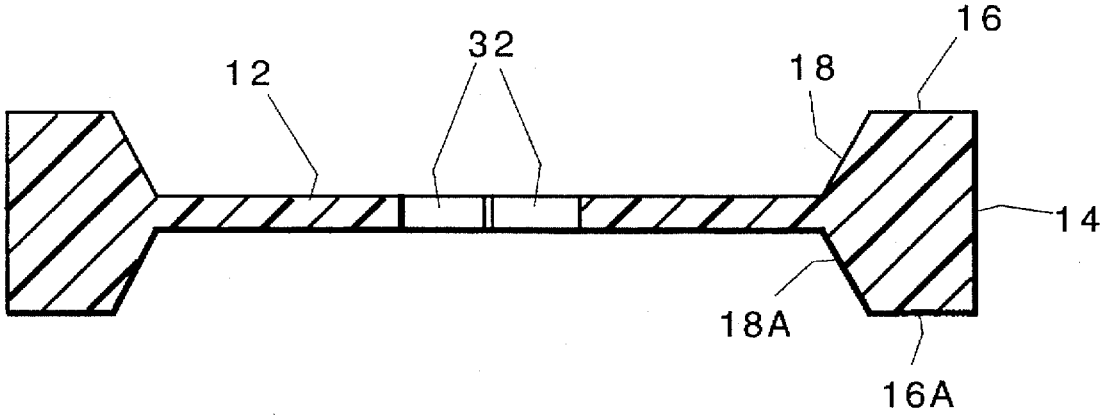
FIG. 1A is a cross sectional view of the invention taken along the line A—A' in FIG. 1.

Concerning FIG. 1A, the panel 12 is shown formed by an injection molding process where the stabilizing ridge 14 is integral with the panel. The stabilizing ridge is not necessarily part of the panel and in fact may be made of other material with the panel clamped or otherwise fastened thereto. As shown, the panel 12 is substantially thinner than the stabilizing ridge 14 which is shown extending above and below the plane of the panel. Surfaces 16A and 18A are mirror images of 16 and 18

Figure 2:
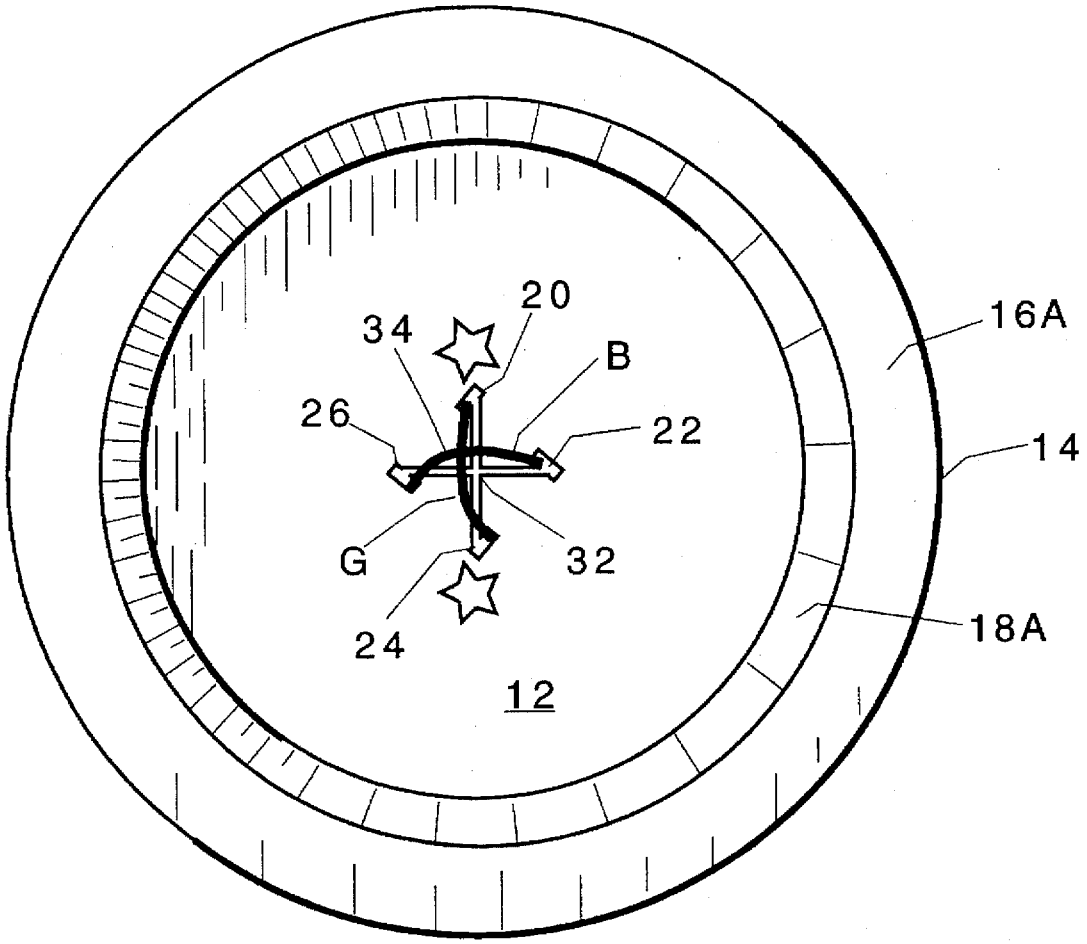
FIG. 2 is a bottom plan view of the invention showing lacing in place.
Figure 3:
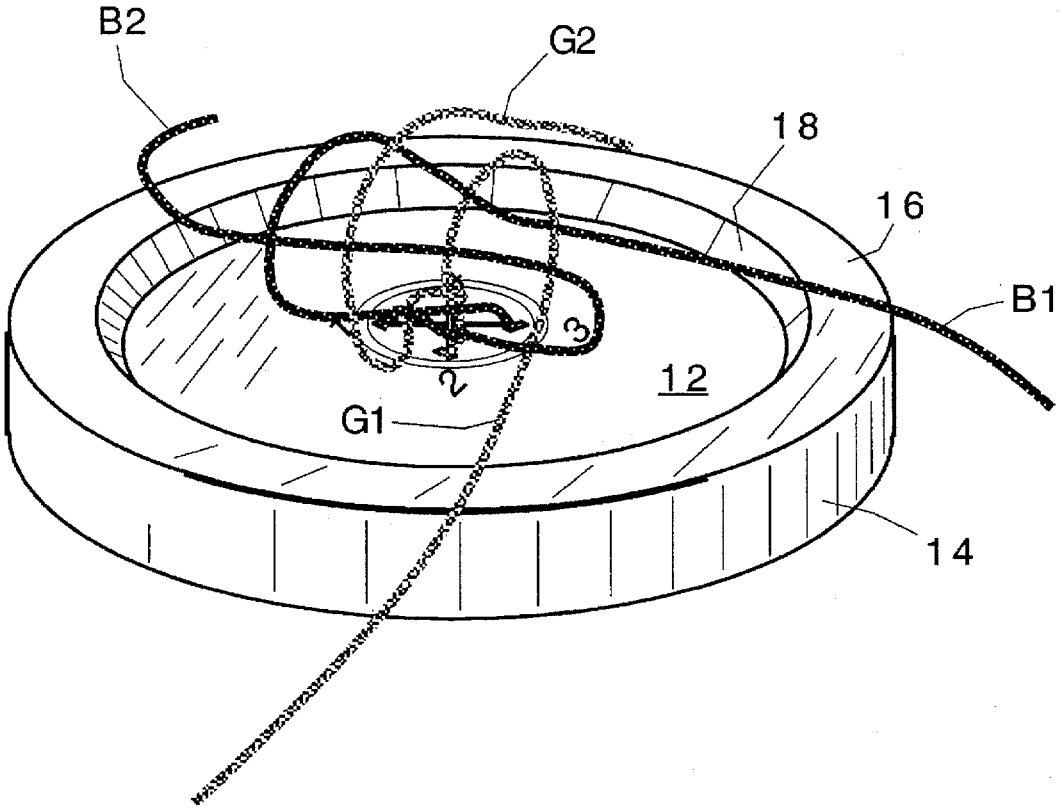
FIG. 3 is a perspective view of the invention showing the first step in lacing after the material is placed in the tool.

Referring to FIG. 2 and FIG. 3, the tool is shown from the bottom or backside in FIG. 2 and the top or front side in FIG. 3. In FIG. 2 the lacing "G" has been first inserted through apertures 20 and 24, subsequently lacing "B" was inserted through apertures 22 and 26 crossing over "G" at a point 34 which corresponds to point 32 on panel 12.

The ends of the lacing, "G1", "G2", "B1" and "B2" are secure and free to be woven, braided, stitched or laced in accordance with the users skills and desires.

When gimp of a sufficient length is formed, whether or not the article is complete, the starter tool may be removed by simply grasping the gimp in one hand and the starter tool in the other and applying a gentle separating force. The panel will flex, temporarily distorting the shape of the apertures thereby releasing the gimp. The panel will resume its original shape and be available for the next project.

Figure 4:
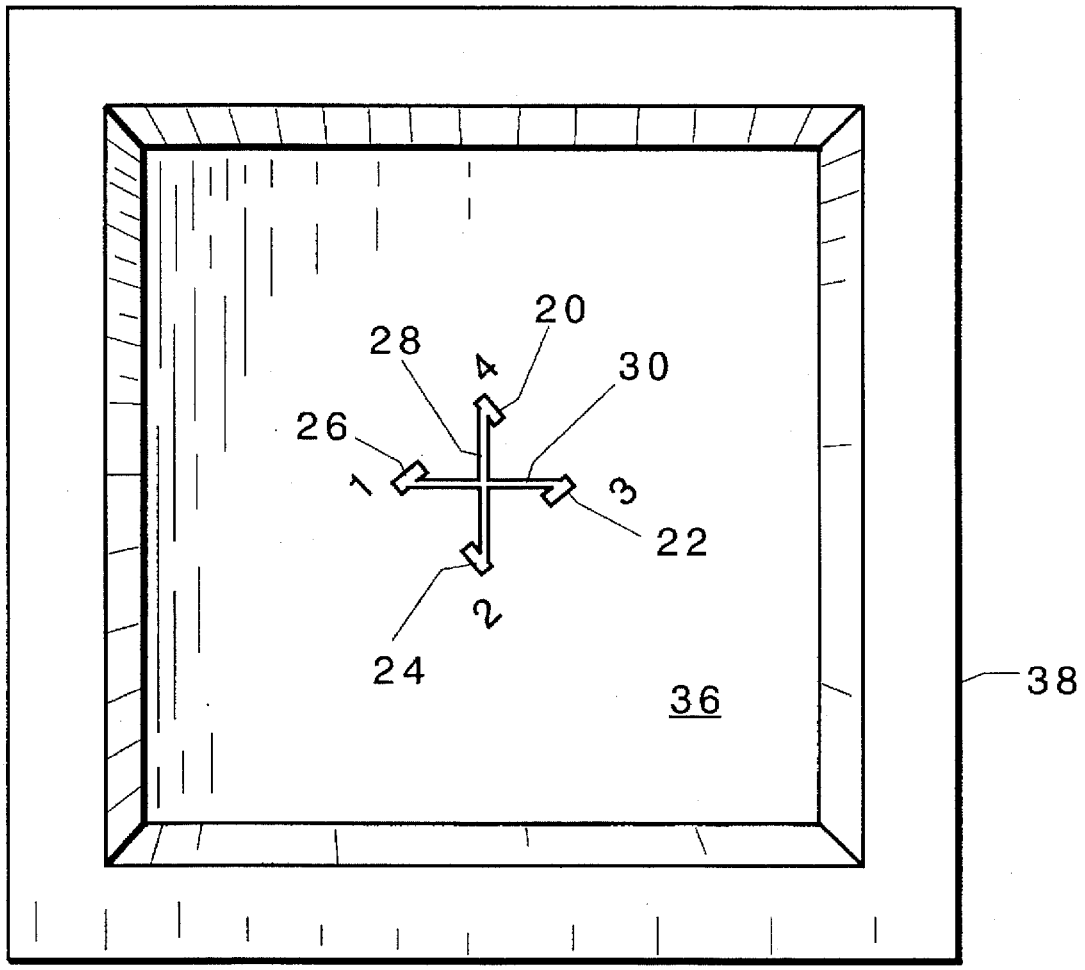
FIG. 4 is top plan view of another embodiment of the invention with a quadrilateral panel and stabilizing ridge.

FIG. 4 shows the tool of the invention with a quadrilateral panel 36 and cooperating stabilizing ridge 38. The apertures 20,22,24 and 26 and channels 28 and 30 shown have the same configuration and dimensions as that shown in FIG. 1.

Figure 5:
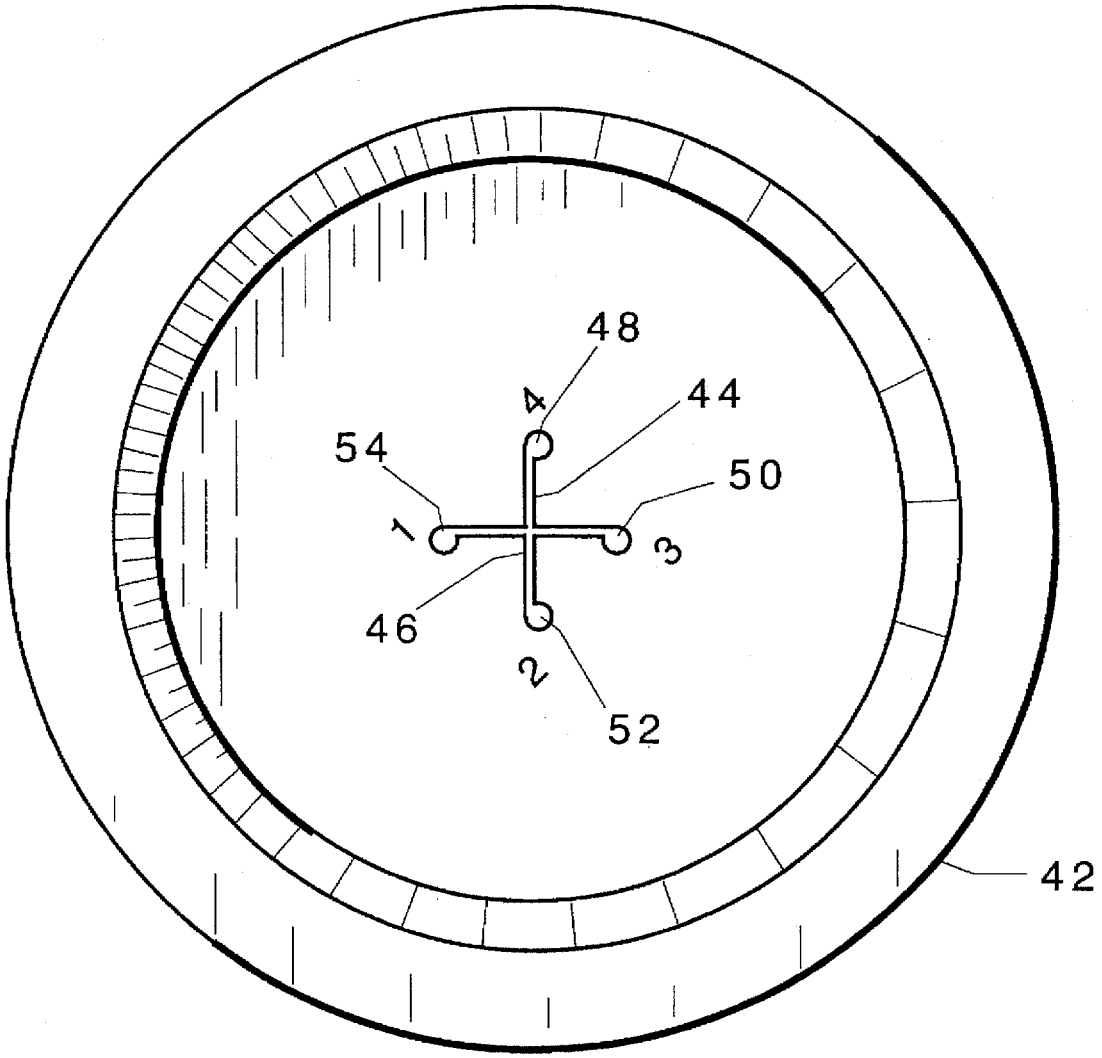
FIG. 5 is top plan view of another embodiment of the invention showing annular apertures for lacing with a circular cross section.

In FIG. 5, an annular panel 40 is shown with a annular stabilizing ring 42 which may be formed in the same manner as the tool of FIG. 1. Centrally located in the panel are transverse intersecting channels 44,46 which terminate in a tangential connections to annular apertures 48,50,52 and 54. Annular apertures are suited to receiving lacing material circular in cross section.

Figure 6:
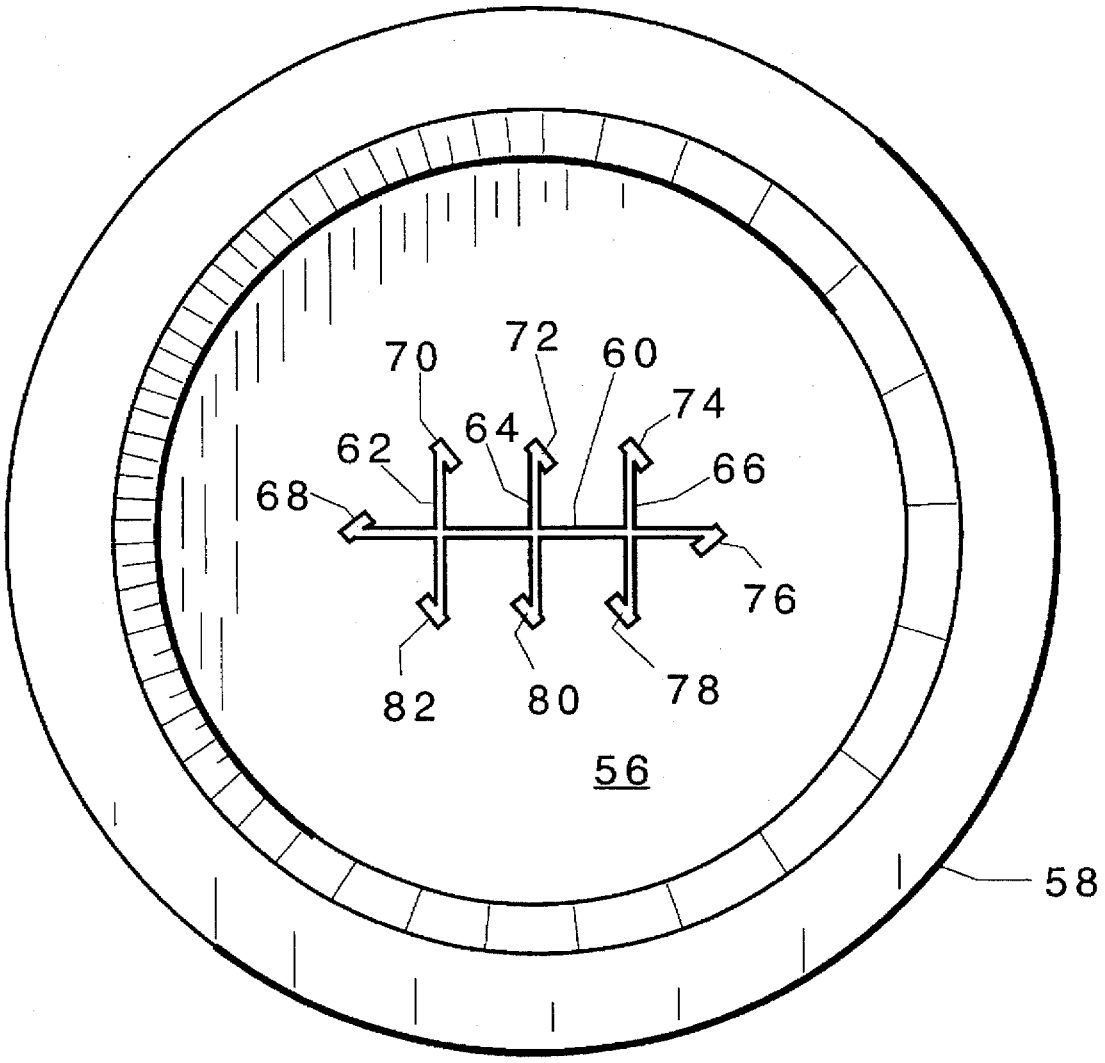
FIG. 6 is a top plan view of the invention showing another embodiment of the invention with multiple apertures and channels.

FIG. 6 shows an annular panel 56 with an annular stabilizing ring 58 formed in the same manner as that described hereinbefore with regard to FIG. 1. The size and dimensions of the panel and stabilizing ring may vary to a reasonable degree, the primary consideration being that the tool is capable of being conveniently held in the hand. The panel contains a single main channel 60 with a series of three, more or less, transverse channels 62,64 and 66. Each channel terminating in a throughgoing aperture 68,70,72,74, 76,78,80,and 82 each shown as a rectangle. Any aperture configuration that matches the cross sectional shape and dimensions of a lacing material is suitable for use with the tool, including the embodiment shown in FIG. 6.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A lacing stitch starter tool comprising:

a) a planar panel means formed of a semi-rigid material;

b) ridge means of non-flexible material forming a boarder around the perimeter of the panel;

c) a plurality of symmetrically positioned aperture means passing through the panel and, d) channel means connecting opposed apertures.

2. A lacing stitch starter tool according to claim 1 wherein: the panel is formed of a polymeric material.

3. A lacing stitch starter tool according to claim 2 wherein: the panel is formed of low-density polyethylene.

4. A lacing stitch starter tool according to claim 3 wherein: the ridge means extends away from the plane of the panel means on two sides.

5. A lacing stitch starter tool according to claim 4 wherein: the ridge means extends away from the plane of the panel means on one side.

6. A lacing stitch starter tool according to claim 5 wherein: the ridge means is an integral part of the planar panel means.

7. A lacing stitch starting tool according to claim 6 wherein: a wall of the ridge means engages the plane of the panel at an angle of ninety degrees.

8. A lacing stitch starting tool according to claim 6 wherein: a wall of the ridge means engages the plane of the panel at an angle of forty-five degrees.

9. A lacing stitch starting tool according to claim 8 wherein: the apertures are adapted to accept lacing material.

10. A lacing stitch starting tool according to claim 9 wherein: the apertures are sized for engaging lacing material with a sliding fit.

11. A lacing stitch starting tool according to claim 10 wherein: the apertures are rectangular in shape.

12. A lacing stitch starting tool according to claim 11 wherein: the longitudinal axis of opposed rectangular apertures are parallel.

13. A lacing stitch starting tool according to claim 12 wherein: opposed rectangular apertures are connected through channel means intersecting the wall of the aperture at an angle of forty-five degrees.

14. A lacing stitch starting tool according to claim 13 wherein: the channel intersection with the wall of the aperture occupies fifty percent of said wall.

15. A lacing stitch starting tool according to claim 14 including: four apertures.

16. A lacing stitch starting tool according to claim 15 including: an even number of apertures more than four.

17. A lacing stitch starting tool according to claim 16 wherein: the panel is annular in shape.

18. A lacing stitch starting tool according to claim 17 wherein: the panel is quadrilateral in shape.

19. A lacing stitch starting tool according to claim 10 wherein: the apertures are annular in shape.

20. An educational tool for teaching lace stitching and braiding comprising:

a) a planar panel means formed of semi-flexible material, capable of being held in the hand;

b) a stabilizing ridge means following the perimeter of the panel and attached thereto or formed therewith;

c) a plurality of symmetrically positioned apertures means passing through the panel means and adapted to engage lacing material with a sliding fit;

d) channel means forming a slot in the panel connecting opposed aperture means, whereby a single length of lacing material passing through oppose apertures will release upon a force being exerted between the lace and panel means.

* * * * *